US006295798B1

(12) United States Patent
Bae et al.

(10) Patent No.: US 6,295,798 B1
(45) Date of Patent: Oct. 2, 2001

(54) METHOD AND APPARATUS FOR MANUFACTURING STEEL CARD

(75) Inventors: Dal Hyang Bae; Yong Min Park; Ju Seok Koh, all of Woolsan-shi (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 09/356,150

(22) Filed: Jul. 19, 1999

(30) Foreign Application Priority Data

Aug. 21, 1998 (KR) ..... 98-33872

(51) Int. Cl.[7] ..... D01H 1/10

(52) U.S. Cl. ..... 57/58.63; 57/58.55; 57/311; 57/902

(58) Field of Search ..... 57/902, 309, 58.63, 57/362, 58.54, 58.55, 311

(56) References Cited

U.S. PATENT DOCUMENTS 3,828,538 * 8/1974 Yoshida et al. ..... 57/58.54
4,566,261 * 1/1986 Brandyberry et al. ..... 57/58.63 X
4,887,421 * 12/1989 Haislet ..... 57/58.54
5,285,623 * 2/1994 Baillievier et al. ..... 57/902 X
5,323,596 * 6/1994 Nguyen ..... 57/902 X
5,512,380 * 4/1996 De Vos et al. ..... 57/902 X
5,581,990 * 12/1996 Van Giel et al. ..... 57/902 X
5,784,874 * 7/1998 Bruyneel et al. ..... 57/902 X

* cited by examiner

*Primary Examiner*—Rodney M. Lindsey
(74) *Attorney, Agent, or Firm*—Clark & Elbing LLP

(57) ABSTRACT

The present invention relates to a method and an apparatus for manufacturing a steel cord. A method according to the present invention comprises the steps of: combining a plurality of the steel filaments supplied from the bobbin by means of the guide rollers; applying a twist pattern to the combined filaments by rotating a pair of flyers arranged between a pair of turn rollers in the counterclockwise direction, and advancing them; applying a further twist pattern to the advanced cord by rotating another pair of flyers arranged between another pair of turn rollers in the reverse direction; stabilizing the cord by means of the overtwist; and winding the resulted cord. The method and apparatus for manufacturing the steel cord have effects that productivity can be improved up to two times or six times even with the same revolution, as compared with the manufacturing apparatus of the prior art.

4 Claims, 3 Drawing Sheets

METHOD AND APPARATUS FOR MANUFACTURING STEEL CARD

BACKGROUND OF THE INVENTION

The present invention relates to a method and an apparatus for manufacturing a steel cord, and more particularly to a method and an apparatus for manufacturing a steel cord which is capable of enhancing the double twist pattern up to four times or six times compared to the prior art by arranging plural pairs of flyers to a twisting unit of the steel cord.

The steel cord is made of a plurality of metal filaments which are carbon steel containing 0.6 to 1.0 percent in weight of carbon and having diameters of 0.1 to 0.4 mm, and which are coated with brass of 0.1 to 0.4 in thickness. The steel filaments are twisted in various patterns according to its use, such as patterns of 1×2, 1×3, 1×4, 2+2, 3+6, and 3+9+15. The steel cord is superior to other inorganic fibers and organic fibers in terms of strength, modulus, thermal resistance, fatigue resistance, etc. Accordingly, the steel cord is primarily used as a reinforcing member for a rubber product, such as a tire.

Generally, the steel cord is manufactured as follows. Selected two or more steel filaments are twisted by the twisting unit of the braiding machine, discharged by the discharging unit, and then wound. The braiding machine for manufacturing the steel cord as mentioned above roughly comprises a filament supplying unit, a twisting unit for twisting a plurality of filaments supplied from the filament supplying unit, a discharging unit for discharging the twisted cord, and winding unit for winding the discharged cord under the fixed tension.

FIG. 1 shows an apparatus for manufacturing a double steel cord of the prior art. As shown in FIG. 1, there is provided a twisting unit including elements which rotate in the same direction and the same angular velocity, the rotating elements consisting of first turn roller 11 arranged at the inlet, second turn roller 12 arranged at the outlet, and a pair of flyers 9, 10 arranged at the inlet and the outlet, respectively.

During the operation of the aforementioned apparatus, the rotating elements rotates counterclockwise in a view of direction from inlet to outlet.

More particularly, as shown in FIG. 1, steel filaments 2 wound on the steel filament bobbin 1 which corresponds to the aforementioned filament supplying unit, are unwound, pass through filament guide rollers 3, 4 respectively, and combined by means of a guide roller 5. The combined two steel filaments 2 is directed to the first turn roller 11 via a guide roller 6. At this time, by the rotation of the flyers 9, 10 at the area between the first turn roller 11 and the second turn roller 12, the twist pitch is applied to the steel cord to form a twist pattern in one direction. Then the cord from the flyers 9, 10 is guided to an overtwister 13, a discharging capstan 14, correcting unit 15, and a guide roller 16 via the second turn roller, 12. Finally, the cord is wound by means of a winding unit 17.

In the apparatus for manufacturing steel cords, productivity depends on the twist pattern of the filaments formed by the twisting unit for twisting the filaments supplied from the filament supplying unit. However, the braiding machine of the prior art as mentioned above has problems that it is not possible to change the twist pattern easily since the twist patterns are predetermined as single or double pattern according to the inherent characteristic of each braiding machine. In order to solve the aforementioned problems, rotation number per minute is increased to advance productivity. However, it is not sufficient to maximize the productivity since increasing of rotation number per minute is limited.

SUMMARY OF THE INVENTION

Accordingly, it is an object of the present invention to provide a method and an apparatus for manufacturing a steel cord which overcome the aforementioned problems encountered in the prior art.

It is another object of the present invention to provide a method and an apparatus for manufacturing a steel cord which is capable of enhancing the productivity by making the apparatus in a manner of folding plural pairs of flyers in order to apply multiple twist to the steel cord.

According to the present invention, there is a method and an apparatus for manufacturing a steel cord which is capable of enhancing the double twist pattern of the steel cord up to six times by arranging plural pairs of flyers used to apply a further twist to a twisting unit of the steel cord, which are rotated relative to the twisting unit.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 2 shows diagrammatically an apparatus for manufacturing a steel cord according to a first embodiment of the present invention. As shown in FIG. 2, steel filaments 2 wound on a steel filament bobbin 1 which corresponds to the filament supplying unit, are unwound from the bobbin 1, pass through filament guide rollers 3, 4 respectively, and combined by means of a guide roller 7. The combined two steel filaments 2 are directed to a second turn roller 12 via a guide roller 8. At this time, by rotating a first pair of flyers 9, 10 arranged between a first turn roller 11 and a second turn roller 12, the combined filaments 2 are advanced with the twist pitch being formed, and twisted in one direction. Then, the steel filaments 2 from the second turn roller 12 are advanced through a second pair of flyers 9', 10' arranged between a third turn roller 11' and a fourth turn roller 12'. The second pair of flyers 9', 10' rotates in a direction opposite to that of the flyers 9, 10 to form a fourfold twist pattern. At this time, each filaments become further twisted to be subject to permanent twist strain, and tend to rotate in the opposite direction by a portion of the elastic strain which remains therein. Accordingly, an overtwister 13 is used to stabilize the rotatability. In order to finish the resulted cord in a straight line, a correcting unit 15 is used to adjust the straightness and the rotatability of the cord prior to the winding step, and then the cord is wound by means of the winding unit 17.

FIG. 3 shows diagrammatically an apparatus for manufacturing a steel cord according to a second embodiment of the present invention. In addition to the apparatus for manufacturing the steel cord according to the first embodiment described above, the apparatus for manufacturing the steel cord according to the second embodiment further includes a fifth turn roller 11" and a sixth turn roller 12", and a third pair of flyers 9", 10" arranged between the fifth turn roller 11" and the sixth turn roller 12", which are rotated in a direction opposite to that of the flyers 9', 10' so that the cord is formed in the sixfold twist pattern. As best shown in FIG. 3, steel filaments 2 wound on the steel filament bobbin 1 are unwound from the bobbin, pass through filament guide rollers 3, 4 respectively, and combined by means of a guide roller 5. The combined two steel filaments 2 are directed to a first turn roller 11 via a guide roller 6. At this time, by rotating a first pair of flyers 9, 10 at the area between a first turn roller 11 and a second turn roller 12, the combined filaments are advanced with the twist pitch being formed, and twisted in one direction. Then, the steel filaments 2 from the second turn roller 12 are advanced through a second pair of flyers 9', 10' arranged between a third turn roller 11' and a fourth turn roller 12'. The second pair of flyers 9', 10' rotates in a direction opposite to that of the flyers 9, 10 to form a fourfold twist pattern. Furthermore, as flyers 9", 10" arranged between the fifth turn roller 11" and the sixth turn roller 12" is rotated in the clockwise direction relative to the counterclockwise rotation of the flyers 9', 10', the cord thus twisted is formed with the sixfold twist pattern. Next steps are identical to those in the first embodiment, and thus the detailed descriptions thereof is omitted.

In the present invention, an apparatus for manufacturing a steel cord comprises a supplying unit for combining a plurality of steel filaments from bobbins and supplying them; a first twisting unit for applying a firs twist pattern to the plurality of steel filaments from the supplying unit comprising a first pair of flyers arranged between a pair of turn rollers; a second twisting unit for applying a second twist pattern to the plurality of steel filaments from the first twisting unit comprising a second pair of flyers arranged between a pair of turn rollers, the first pair of flyers are arranged between the second pair of layers and rotating direction of the second pair of flyers is opposite to that of the first pair of flyers. It is natural that the apparatus for manufacturing a steel cord further comprises flyers capable of rotating in the reverse direction to form a third twisting unit, in addition to the first and second twisting units.

The present invention will be understood more readily with reference to the following examples. However, these examples are intended to illustrate the invention and are not to be construed to limit the invention.

EXAMPLE 1

Figure 1:
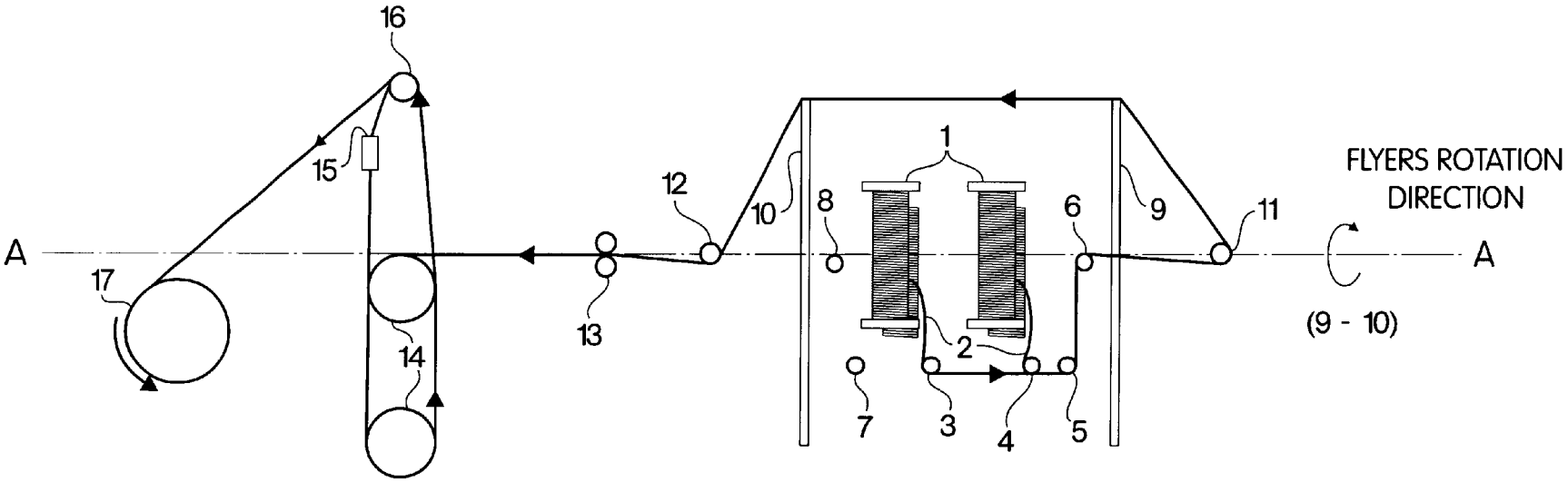
Fig. 1 (Prior Art)
FIG. 1 shows diagrammatically an apparatus for manufacturing a steel cord in a double twist pattern of the prior art.
Figure 2:
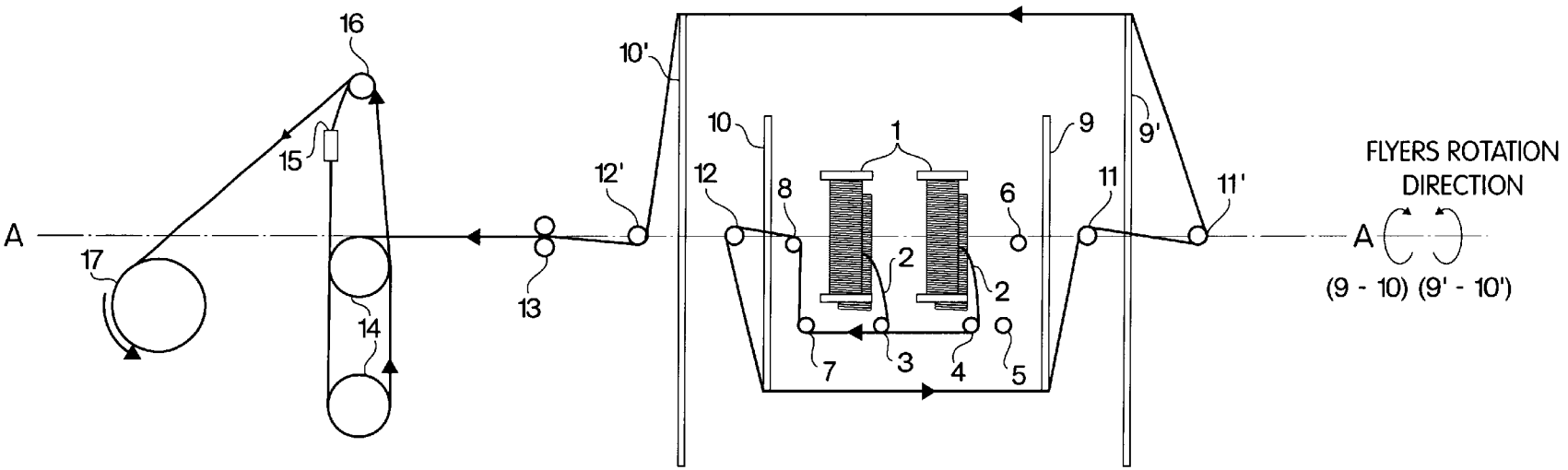
FIG. 2 shows diagrammatically an apparatus for manufacturing a steel cord in a fourfold twist pattern according to a first embodiment of the present invention.
Figure 3:
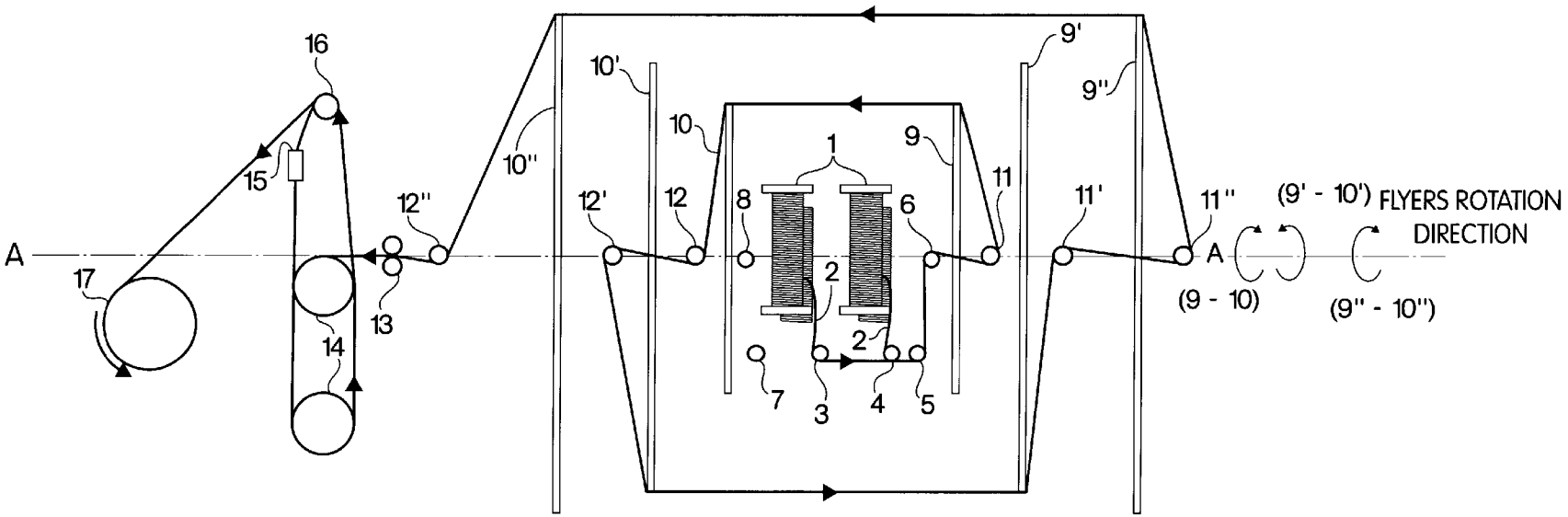
FIG. 3 shows diagrammatically an apparatus for manufacturing a steel cord in a sixfold twist pattern according to a second embodiment of the present invention.

With the manufacturing apparatus shown in FIG. 2, the steel filaments 2 wound on the steel filament bobbin 1 was unwound from the bobbin, passed through the filament guide rollers 3, 4 respectively, and combined by means of a guide roller 7. The combined two steel filaments 2 were directed to the second turn roller 12 via the guide roller 8. At this time, by the rotation in the clockwise direction of the first pair flyers 9, 10 at the area between the first turn roller 11 and the second turn roller 12, the combined filaments were advanced with the twist pitch being formed, and twisted in one direction. As the flyers 9', 10' arranged between the third turn roller 11' and the fourth turn roller 12' were rotated in the direction opposite to that of the flyers 9, 10, the cord was formed with the fourfold twist pattern. The resulted cord passed through the overtwist 13 and the correcting unit 15, and then it was wound. Consequently, the completed steel cord was obtained. At this time, the total number of revolutions of flyers was 14,000 rpm, The structural pitch 14 mm, the unit weight 1.12 g/m, the rate of the operation 80%. Table 1 shows the production efficiency in the term of the productivity and the amount of the production.

EXAMPLE 2

The steel cord was manufactured in the same process as in example 1 except that the cord was formed with the fourfold twist pattern by the total rotation of flyers of the 14,000 rpm, and afterwards the cord was formed with the sixfold twist pattern by the total rotation of flyers of 21,000 rpm by adding 7000 rpm with the reverse rotation. The resulted production efficiency is indicated in Table 1.

COMPARATIVE EXAMPLE 1

The steel cord was obtained without any twist pattern of the filaments themselves by the total rotation of flyers of 3,500 rpm in the braiding machine for a single steel cord of the prior art. The resulted production efficiency is indicated in Table 1.

COMPARATIVE EXAMPLE 2

The steel cord was obtained with double twist pattern by the total rotation of flyers of 7,000 rpm in the braiding machine for a double steel cord of the prior art. The resulted production efficiency is indicated in Table 1.

TABLE 1

| Class | The number of the flyer | Total Rpm of the flyer(s) | Amount of production (T/Month) | Productivity |
|---|---|---|---|---|
| Comparative example 1 | 1 | 3,500 | 1.89 | 1 time |
| Comparative example 2 | 2 | 7,000 | 3.79 | 2 times |
| Example 1 | 4 | 14,000 | 7.58 | 4 times |
| Example 2 | 6 | 21,000 | 11.34 | 6 times |

Remarks:
1. All the examples and comparative examples are in 1 × 2 × 0.30 HT constructions
2. The amount of the production of the steel cord: The amount of the production (= rpm × structural pitch × 60 (minutes) × 24 (hours) × 30 (days) × unit weight × rate of the operation) was sought and compared.

As described above, in case that the steel cord is manufactured with the apparatus for manufacturing the steel cord according to the present invention, the twist pattern can be increased even with the same revolution, thereby the productivity can be improved up to four times or six times as compared with the single manufacturing apparatus of the prior art, and up to two times or three times compared with the double manufacturing apparatus of the prior art.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A method for manufacturing a steel cord, the method comprising the steps of: combining a plurality of steel filaments supplied from bobbins; advancing the plurality of steel filaments to a first pair of flyers to form them into a first twist pattern; and advancing the plurality of steel filaments from the first pair of flyers to a second pair of flyers to form them into a second twist pattern, wherein the first pair of flyers are arranged between the second pair of flyers, and wherein the rotating direction of the second pair of flyers is opposite to that of the first pair of flyers.

2. The method according to claim 1, further comprising the steps of advancing the plurality of steel filaments from the second pair of flyers to a third pair of flyers the second pair of flyers arranged between the third pair of flyers, wherein the rotating direction of the third pair of flyers is opposite to that of the second pair of flyers.

3. An apparatus for manufacturing a steel cord, the apparatus comprising: a supplying unit for combining a plurality of steel filaments from bobbins; a first twisting unit for applying a first twist pattern to the plurality of steel filaments from the supplying unit, said first twisting unit comprising a first pair of flyers arranged between a pair of turn rollers; a second twisting unit for applying a second twist pattern to the plurality of steel filaments from the first twisting unit, said second twisting unit comprising a second pair of flyers arranged between a pair of turn rollers, wherein the first pair of flyers are arranged between the second pair of flyers and wherein the rotating direction of the second pair of flyers is opposite to that of the first pair of flyers.

4. The apparatus according to claim 3, further comprising a third twisting unit for applying a third twist pattern to the plurality of steel filaments from the second twisting unit, said third twisting unit comprising a third pair of flyers arranged between a pair of turn rollers, wherein the second pair of flyers are arranged between the third pair of flyers and wherein the rotating direction of the third pair of flyers is opposite to that of the second pair of flyers.

* * * * *

UNITED STATES PATENT AND TRADEMARK OFFICE

CERTIFICATE OF CORRECTION

PATENT NO. : 6,295,798 B1
DATED : October 2, 2001
INVENTOR(S) : Dal Hyang Bae et al.

It is certified that error appears in the above-identified patent and that said Letters Patent is hereby corrected as shown below:

Title page, Item [54] and Column 1, line 2,
Delete the word "CARD" and replace with -- CORD --;

Title page,
Item [57], ABSTRACT,
Line 16, please add the following as the last sentence of the ABSTRACT:
-- The steel cord manufactured according to the present invention is used as a reinforcing member for rubber products, such as tires, industrial belts, etc. --;

Column 1,
Line 10, please insert -- Description of Prior Art --;

Column 3,
Line 33, delete "firs" and insert -- first --;

Column 4,
Line 37, in Table 1, delete "3.79." and insert -- 3.79 --;
Line 2, delete ", rmp" and insert -- rpm. --;

Column 5,
Lines 7-8, delete "the second pair of flyers arranged between the third pair of flyers" and insert -- arranged betweeen the second pair of flyers --.

Signed and Sealed this

Second Day of September, 2003

JAMES E. ROGAN
*Director of the United States Patent and Trademark Office*